US010155142B2

(12) United States Patent
Kato

(10) Patent No.: US 10,155,142 B2
(45) Date of Patent: Dec. 18, 2018

(54) WOOD-TYPE GOLF CLUB HEAD

(71) Applicant: SUMITOMO RUBBER INDUSTRIES, LTD., Kobe-shi, Hyogo (JP)

(72) Inventor: Akira Kato, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/853,198

(22) Filed: Dec. 22, 2017

(65) Prior Publication Data

US 2018/0178088 A1 Jun. 28, 2018

(30) Foreign Application Priority Data

Dec. 28, 2016 (JP) ..... 2016-255217
Oct. 10, 2017 (JP) ..... 2017-196687

(51) Int. Cl.
*A63B 53/04* (2015.01)

(52) U.S. Cl.
CPC ..... *A63B 53/0466* (2013.01); *A63B 53/04* (2013.01); *A63B 2053/0416* (2013.01); *A63B 2053/0445* (2013.01); *A63B 2053/0458* (2013.01)

(58) Field of Classification Search
CPC .... A63B 2053/0445; A63B 2053/0416; A63B 53/0466; A63B 53/04
USPC ..... 473/330, 331, 342, 345
See application file for complete search history.

(56) References Cited

U.S. PATENT DOCUMENTS 6,475,099 B1 11/2002 Sumitomo et al.
7,780,549 B2 * 8/2010 Park ..... A63B 53/047 473/330
9,504,885 B2 * 11/2016 Ban ..... A63B 53/0466
9,868,037 B1 * 1/2018 Ripp ..... A63B 53/04

FOREIGN PATENT DOCUMENTS

JP 2000-5352 A 1/2000
JP 2004-201787 A 7/2004

* cited by examiner

*Primary Examiner* — Benjamin Layno
(74) *Attorney, Agent, or Firm* — Birch, Stewart, Kolasch & Birch, LLP

(57) ABSTRACT

A wood-type golf club head comprises a face portion having a face for striking a ball. The face comprises a first region having a surface roughness and a second region having a surface roughness larger than that of the first region. The first region is positioned centrally in a toe-heel direction of the face and in an upper side of the face. The second region is positioned adjacently to the first region on a toe side, a heel side and a lower side of the first region and the second region is formed in a U-shape in the front view of the head.

14 Claims, 6 Drawing Sheets

E1section

WOOD-TYPE GOLF CLUB HEAD

TECHNICAL FIELD

The present invention relates to a wood-type golf club head and, more particularly to a face portion of a wood-type golf club head capable of improving variations of flight distances and directions of hit balls.

BACKGROUND ART

When a ball is hit with a golf club head whose face has a loft angle, a backspin occurs on the hit ball based on the friction force between the face and the ball. It has been believed that the loft angle and the friction coefficient of the face become greater, the backspin becomes increased.

However, in the case of golf club heads such as wood-type golf club heads whose loft angle is small, it has been known through various experiments that as the friction coefficient of the face becomes large, the backspin is reduced, and that as the friction coefficient of the face becomes small, the backspin is increased (see the following Patent Document 1). Such a phenomenon is believed to be caused by a recoil occurring in the interior of the ball.

The recoil is a type of resilience of a golf ball in which an elastic torsional deformation is caused by the contact with the club face, and the recoil returns the golf ball to its original state. In general, if the recoil occurs strongly, the backspin is reduced.

In the case of a golf club head whose loft angle is small, as the friction coefficient of the face becomes large, the recoil is relatively increased, and the backspin of the ball is reduced. In the case of a golf club head whose loft angle is small, as the friction coefficient of the face becomes small, the recoil is hindered, and the backspin of the ball is increased.

The following Patent Document 2 discloses a golf club head utilizing a phenomenon as described above, wherein an upper region of the face located upper than the sweet spot of the face has a ten-point average roughness being smaller than 1.5 micrometers, and a lower region of the face located lower than the sweet spot of the face has a ten-point average roughness of 1.5 to 10 micrometer.

When a ball is hit by the upper region of the face, usually, the backspin of the ball is reduced by a gear effect. However, in the wood-type golf club head disclosed in the Patent Document 2, as the upper region of the face is decreased in the friction coefficient, the action of the recoil is reduced, and it is possible to prevent a significant decrease in the backspin of the ball.

On the other hand, when a ball is hit by the lower region of the face, usually, the backspin of the ball is increased by a gear effect. However, in the wood-type golf club head disclosed in the Patent Document 2, as the lower region of the face is increased in the friction coefficient, the action of the recoil is strengthened, and it is possible to prevent a significant increase in the backspin of the ball.

Thus, in the golf club head according to the Patent document 2, it is possible to stabilize the flying distances of the hit balls even if the hitting position varies above and below the face.

Patent Document 1

Japanese Patent Application Publication No. 2000-5352

Patent Document 2

Japanese Patent Application Publication No. 2004-201787

SUMMARY OF THE INVENTION

Problems to be Solved by the Invention

However, even in the wood-type golf club head according to the Patent Document 2, there is a problem such that, if a hitting position varies in the toe-heel direction (lateral direction) of the face, the flying distance is liable to vary.

The present invention was made in view of the above problem, and a main object of the present invention is to provide a wood-type golf club head capable of improving variations of flight distances and directions of hit balls.

According to the present invention, a wood-type golf club head comprises:

a face portion having a face for striking a ball, the face comprising a first region having a surface roughness and a second region having a surface roughness larger than that of the first region, wherein the first region is positioned centrally in a toe-heel direction of the face and in an upper side of the face, and the second region is positioned adjacently to the first region on its toe side, heel side and lower side and the second region is formed in a U-shape in the front view of the head.

The wood-type golf club head according to the present invention may have the following features:

(1) a toe side part and a heel side part of the second region extend to an upper edge of the face;

(2) the boundary between the first region and the second region is curved convexly toward a lower side of the face in an arc in the front view of the head;

(3) the lowest point or lower end of the first region is located at a position not lower than a point at ½ of the maximum height of the face;

(4) the lowest point or lower end of the first region is located at a position not higher than a point at ⅔ of the maximum height of the face;

(5) a moment of inertia of the head about a vertical axis passing through the center of gravity of the head is from 3500 to 6000 (g sq. cm), and the face is provided with a bulge having a radius of from 10 to 16 inches;

(6) the difference in the arithmetic average roughness Ra between the first region and the second region is not less than 0.5 micrometers, and the difference in the maximum height roughness Rz between the first region and the second region is not less than 5 micrometers;

(7) the difference in the arithmetic average roughness Ra between the first region and the second region is not less than 0.5 micrometers and not more than 4.0 micrometers, and the difference in the maximum height roughness Rz between the first region and the second region is not less than 5 micrometers and not more than 15 micrometers.

According to the present invention, the wood-type golf club head comprises the face having the first region and the second region, wherein the first region is positioned centrally in the toe-heel direction of the face and in the upper side of the face, and the second region is positioned adjacently to the first region on its toe side, heel side and lower side and is formed in the U-shape in the front view of the face. And the surface roughness of the second region is larger than that of the first region.

In the wood-type golf club head according to the present invention, since the first region has the low frictional surface, the action of the recoil when hitting a ball by an upper central position of the face is reduced, and as a result, a significant reduction of the backspin can be suppressed.

Further, in the wood-type golf club head according to the present invention, because the second region has the high frictional surface, the action of the recoil when hitting a ball by a lower central position of the face is reduced, and as a result, a significant reduction of the backspin can be suppressed.

Furthermore, in the wood-type golf club head according to the present invention, since the second region having the high frictional surface forms the toe side part and the heel side part of the face, the action of the recoil when hitting a ball by the toe side part or heel side part of the face is enhanced, and as a result, a significant increase in the sidespin of the ball can be suppressed. This prevent the trajectory of the flying ball from being bent in the lateral direction, and the variation in the flying distance is suppressed.

As described above, in the wood-type golf club head according to the present invention, even if the ball hitting position is varied in the top and bottom direction as well as in the right and left direction of the face, it is possible to stabilize the flying distances of the hit balls.

DESCRIPTION OF THE PREFERRED EMBODIMENTS

Embodiments of the present invention will now be described with reference to the accompanying drawings. specific configurations of the embodiments which will be illustrated by the following description and drawings are only for understanding of the contents of the present invention. Thus, those specific configurations should not be construed as to limit the scope of the present invention.

Figure 1:
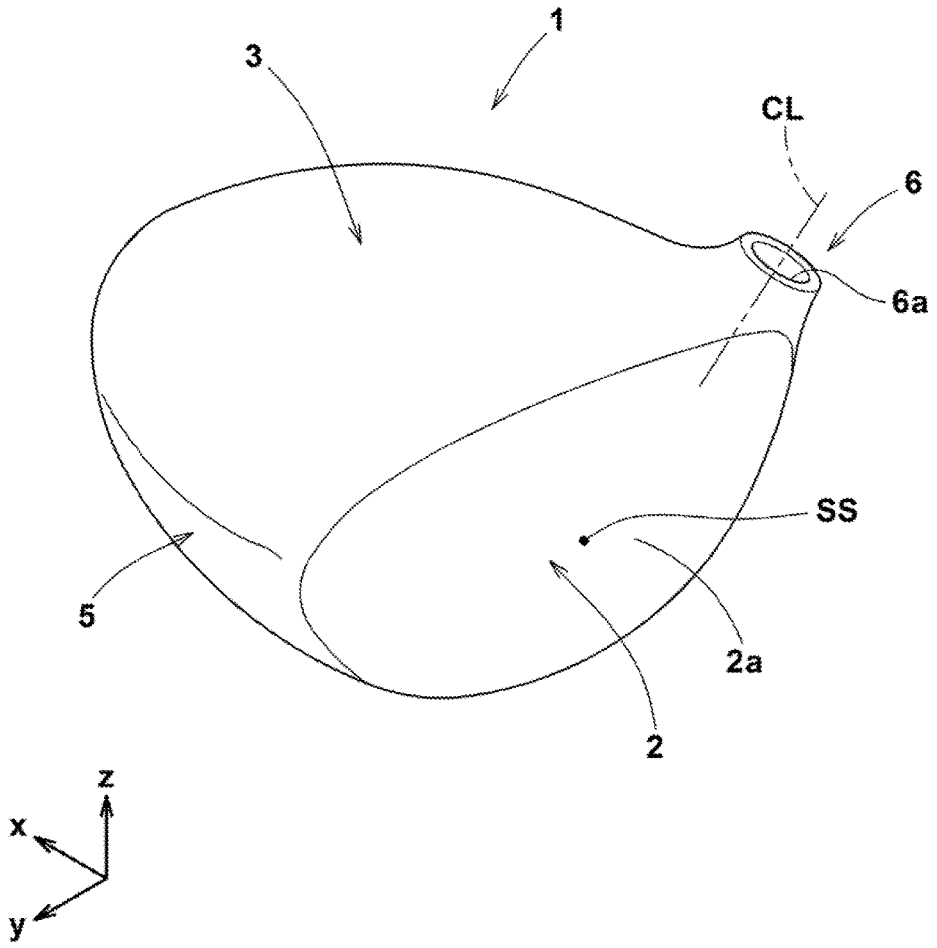
FIG. 1 is a perspective view of a wood-type golf club head as an embodiment of the present invention.
Figure 2:
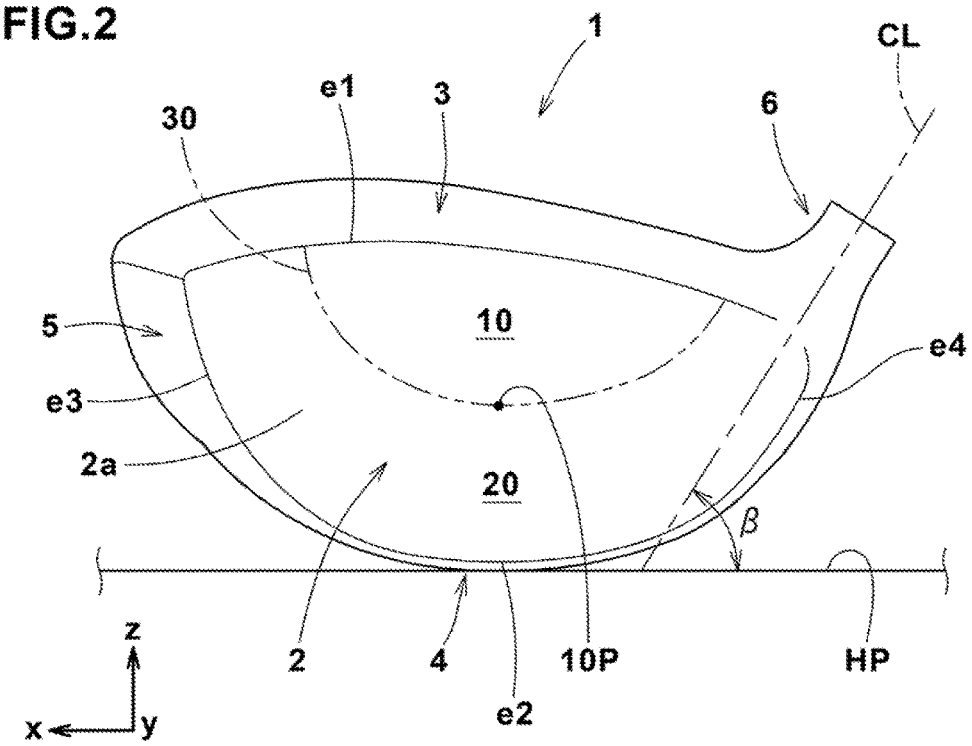
FIG. 2 and FIG. 7 are a front view thereof differently annotated.
Figure 3:
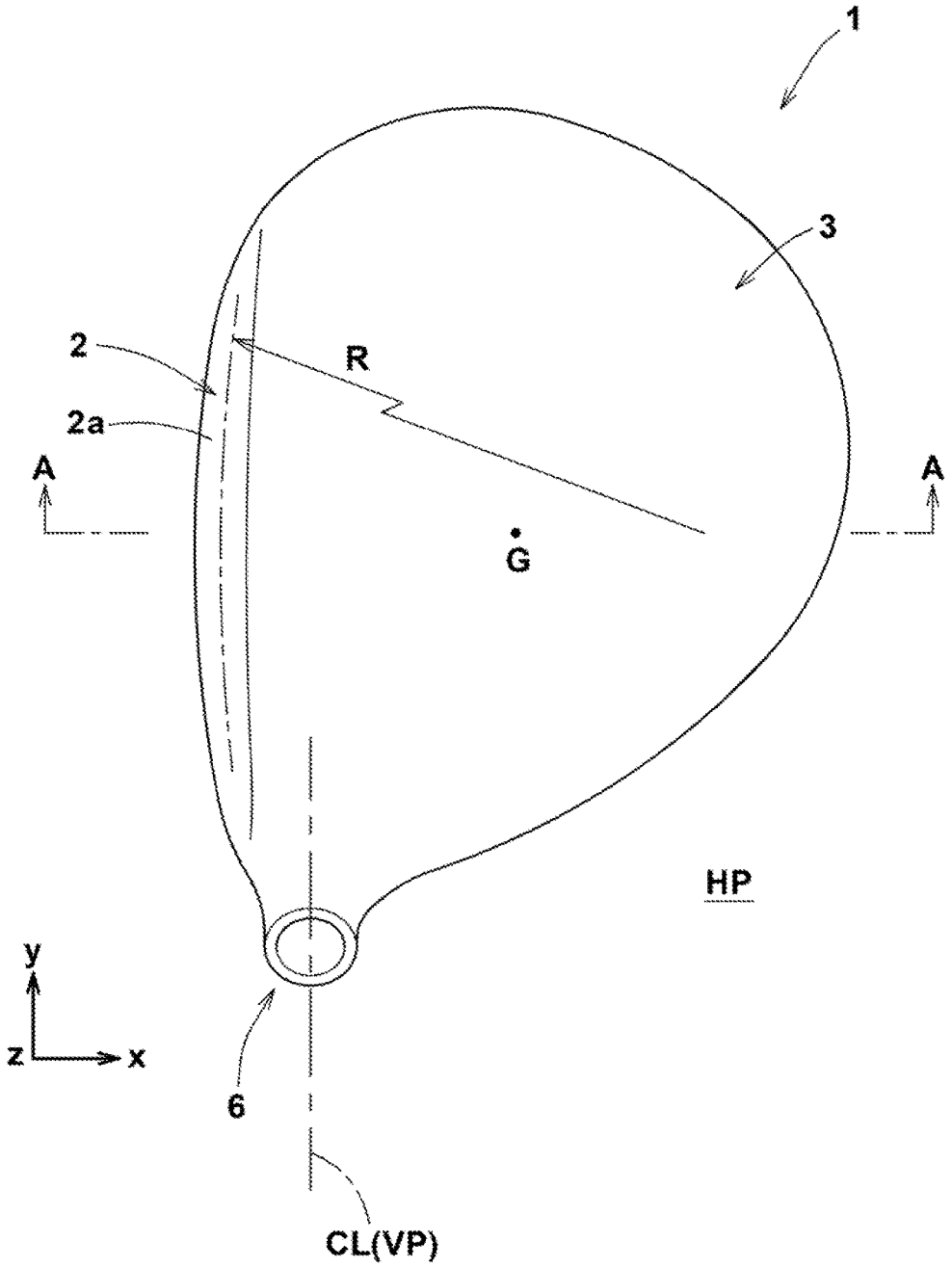
FIG. 3 is a top view thereof.

FIGS. 1-4 are a perspective view, a front view, a top view and a cross sectional view, respectively, of a golf club head 1 as an embodiment of the present invention (hereinafter, sometimes simply referred to as the "head 1"). The cross sectional view is taken along line A-A of FIG. 3. In FIGS. 1-3, the head 1 which is in its reference state is shown.

[Reference State of Head]

The above-said reference state of a head is a state of the head which is set on a horizontal plane HP such that the center line CL of the club shaft is inclined at its lie angle beta (FIG. 2), while keeping the center line CL on a vertical plane VP, and the face forms its loft angle alpha (FIG. 4) with respect to the horizontal plane HP.

The term "front-back direction" is a direction (x) parallel with a straight line N projected on the horizontal plane HP, wherein the straight line N is drawn normally to the face passing through the center G of gravity of the club head.

The term "toe-heel direction" is a direction (y) parallel with the horizontal plane HP and perpendicular to the front-back direction.

The term "up-down direction" is a direction (z) perpendicular to the horizontal plane HP.

In this application including the description and claims, dimensions, positions, directions and the like relating to the head refer to those under the reference state of the club head unless otherwise noted.

[Basic Configuration of the Head]

In the present embodiment as shown in FIGS. 1-4, the head 1 is a wood-type hollow head with an inner cavity (i) therein. The head 1 is designed for a wood-type golf club, preferably for a driver. Here, the wood-type golf clubs include at least number 1 to 5 woods, and clubs whose heads have similar shapes, for example a utility type, may be included.

Preferably, such wood-type heads may have loft angles $\alpha$ of not more than 35 degrees, more preferably not more than 26 degrees.

In the present embodiment, the head 1 is made of one or more metal materials. The metal materials are not particularly limited. For example, stainless steels, maraging steels, pure titanium, titanium alloys, aluminum alloys and the like can be preferably used alone or in combination. Nonmetallic materials such as fiber-reinforced resins may be used as a part of the head.

In the present embodiment, the head 1 comprises a face portion 2, a crown portion 3 a sole portion 4 and a side portion 5.

The face portion 2, the crown portion 3, the sole portion 4 and the side portion 5 surround the above-said inner cavity (i) and form a shell structure with the thin wall.

The front face of the face portion 2 constitutes the face 2*a* for striking a ball. The face 2*a* may be provided with score lines or small grooves (not shown) extending in the toe-heel direction.

The face 2*a* has the peripheral edge made up of an upper edge e1, a lower edge e2, a toe-side edge e3 and a heel side edge e4 as shown in FIG. 2.

If the edges e1-e4 are unclear due to smooth change in the curvature, virtual edge lines are used instead.

The virtual edge lines are defined based on the curvature change as follows.

Figure 4:
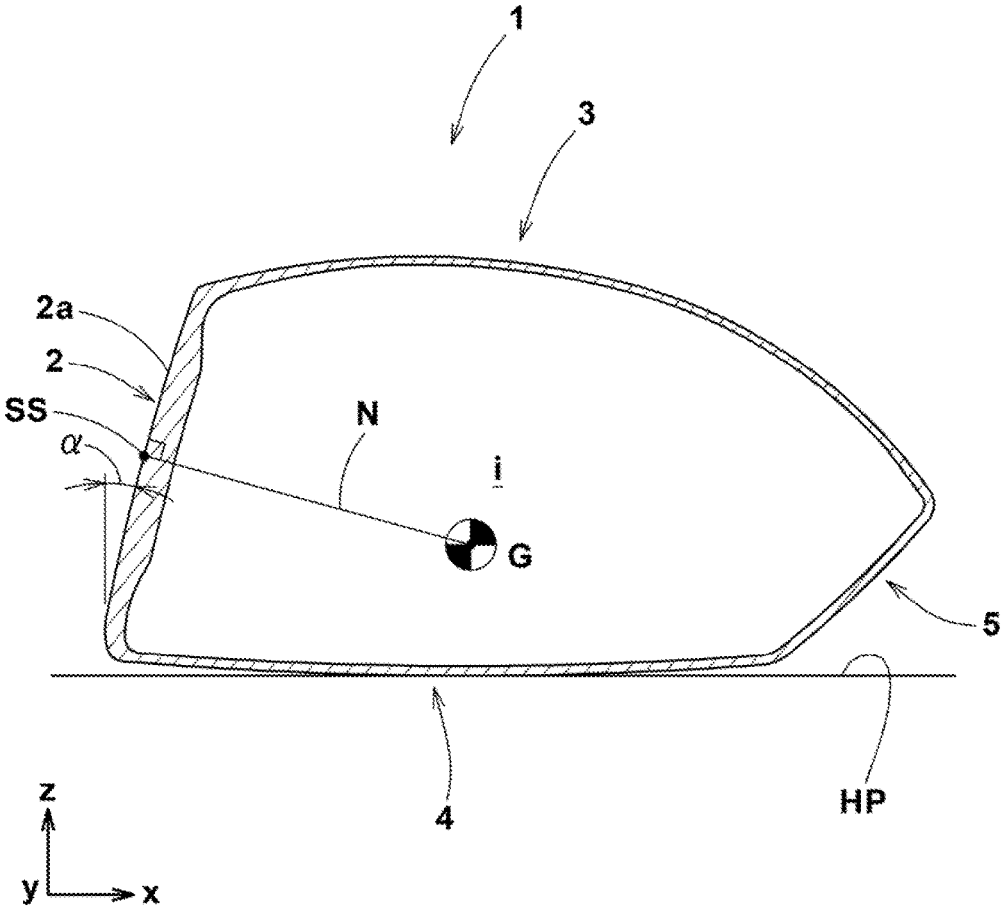
FIG. 4 is a sectional view taken along line A-A of FIG. 2.
Figure 5A:
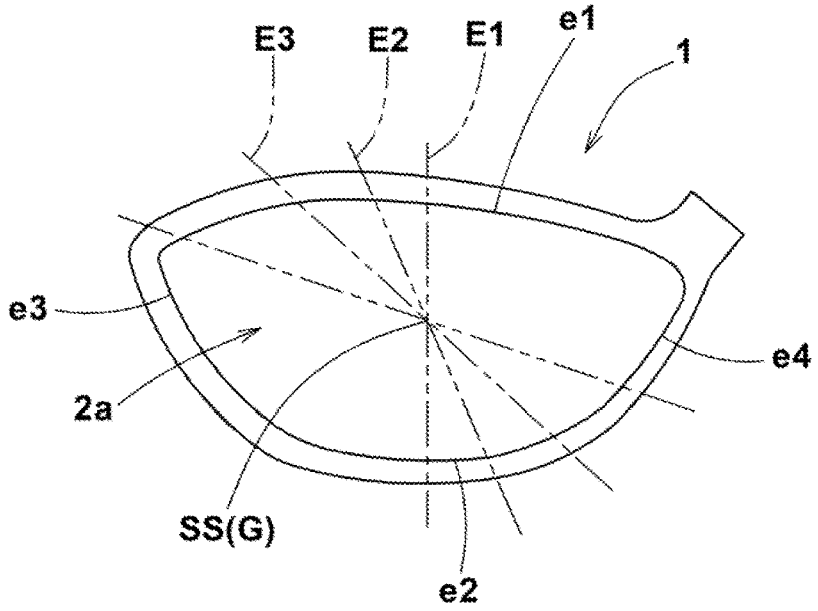
FIGS. 5(A) and 5(B) are a front view and a cross sectional partial view of a golf club head for explaining the edge of the face.
Figure 5B:
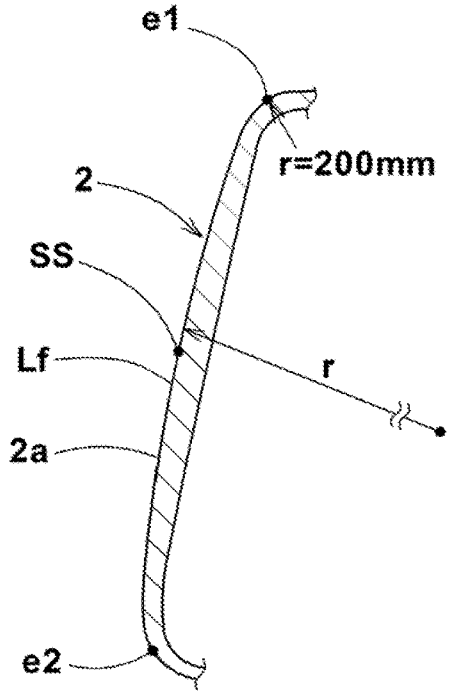

As shown in FIG. 5(A), in each cutting plane E1, E2 - - - including the straight line N (FIG. 4) extending between the sweet spot ss and the center of gravity G of the head, as shown in FIG. 5(B), a point (e1, e2, - - - ) at which the radius (r) of curvature of the profile line Lf of the face portion first becomes under 200 mm in the course from the sweet spot SS to the periphery of the face portion is determined.

Then, the virtual edge line are defined as a locus of the determined points (e1, e2, - - - ).

Incidentally, the profile line Lf does not include profile lines of small grooves such as score lines disposed in the face.

The crown portion 3 extends backward from the face portion 2, defining the upper surface of the head as shown in FIGS. 1 and 4. The crown portion 3 may be provided in its heel side part with a tubular hosel portion 6 having a shaft inserting hole 6*a* to be attached to a tip end of a club shaft (not shown). Incidentally, the center line of the shaft insertion hole 6*a* corresponds to the axis CL of the club shaft.

The sole portion 4 extends backward from the face portion 2, defining the bottom surface of the head as shown in FIG. 4.

The side portions 5 extends between the crown portion 3 and the sole part 4 and extends from the toe side edge to the heel side edge of the face portion 2 through the back side of the head as shown in FIGS. 1 to 3.

In the present embodiment, the head 1 has a large volume of preferably not less than 200 cc, more preferably not less than 250 cc, still more preferably not less than 300 cc. such head 1 is increased in the moment of inertia about the vertical axis passing through the center of gravity G of the head in the reference state (hereinafter, referred to as the "lateral moment of inertia").

Preferably, the lateral moment of inertia of the head 1 in the present embodiment is from 3500 to 6000 (g sq. cm).

In the head 1 having such large lateral moment of inertia, the lateral gear effect hardly occurs.

Figure 6A:
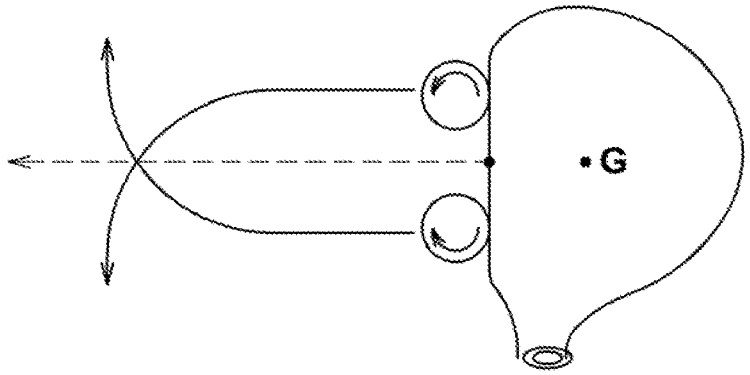
FIGS. 6(A), 6(B) and 6(*c*) are diagrams for explaining heel hitting and toe hitting.

The lateral gear effect is such a phenomenon that, at the moment of hitting a ball with a toe side part or heel side part of the face as shown in FIG. 6(A), the head is rotated around the above-mentioned vertical axis by a small angle, and a side spin is caused inversely with the head's rotation on the ball by the friction with the face, which results in a hook or slice shot, that is, the trajectory of the ball is curved to the right or left. Thus, the side spin deteriorates the directionality of the hit ball with respect to the target direction.

In the case of a head having a large lateral moment of inertia, even if the ball hitting position is off centered toward the toe or heel, the rotational angle of the head described above becomes smaller, and the side spin of the ball is reduced accordingly. Thus, the directionality of the hit ball can be stabilized.

In order to further stabilize the directionality of the hit ball to suppress the decrease in the flying distance of the hit ball, it is desirable that the bulge radius R (shown in FIG. 3) of the face 2*a* is set in a range from 10 to 16 inches (254 to 406.4 mm). Here, the bulge radius means the radius of curvature of the horizontal bulge across the face from heel to toe.

Figure 6B:
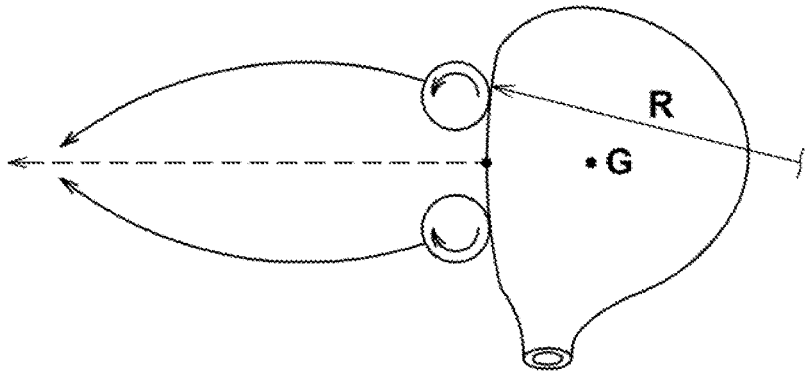

The original purpose of providing the face bulge is to shot a ball to the right or left with respect to the target trajectory as shown in FIG. 6(B) when the ball hitting position is off centered toward the toe or heel of the face 2*a*. When off centered toward the toe or heel, the ball will hook or slice by the lateral gear effect as described above.

However, as the shot direction of the ball due to the face bulge is oriented oppositely to the direction to which the ball may be curved, both are offset, and the directionality of the ball with respect to the target trajectory is improved.

Figure 6C:
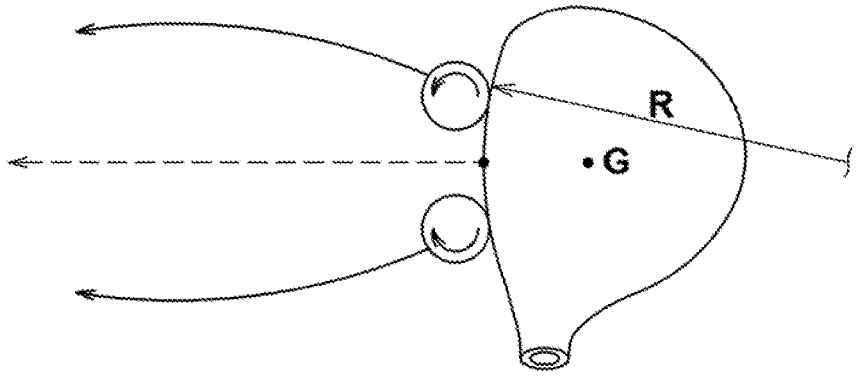

On the other hand, in the case of the head whose lateral moment of inertia is large, the lateral gear effect is small, and the side spin of the ball becomes less. Therefore, when the bulge radius R is small, the ball shot to the right or left can not return to the target trajectory as shown in FIG. 6(*c*).

From this point of view, in the present embodiment, the bulge radius R is set in a range from 10 to 16 inches.

The face 2*a* of the head 1 comprises a first region 10 and a second region 20 as shown in FIG. 2.

The first region 10 is positioned centrally in the toe-heel direction of the face 2*a* and formed in an upper side of the face 2*a*. More specifically, the first region 10 extends from a central part of the upper edge e1 of the face 2*a* toward the lower edge e2 of the face 2*a*, and is terminated without reaching the lower edge e2, toe-side edge e3 and the heel-side edge e4 of the face 2*a*.

The second region 20 is formed to abut on the toe side, heel side and lower side of the first region 10 so as to have a U-shape in the front view of the head. In the present embodiment, the second region 20 extends from a toe-side part of the upper edge e1 of the face 2*a* to a heel-side part of the upper edge e1 of the face 2*a* along the first region 10. Further, the second region 20 extends to the lower edge e2, the toe side edge e3 and the heel side edge e4.

Thus, the second region 20 forms the rest of the face 2*a* excluding the first region 10 in substance.

According to the present invention, the surface roughness of the second region 20 is set to be larger than the surface roughness of the first region 10. Therefore, the second region 20 has a higher coefficient of friction than the first region 10. Therefore, when a ball is hit by the upper central part of the face 2*a* of the head 1, the ball is in contact with the first region 10 having the relatively low coefficient of friction. Accordingly, the action of the recoil of the ball is reduced, and it becomes possible to prevent the backspin from being largely reduced.

On the other hand, when a ball is hit by a lower part of the face 2*a* of the head 1, the ball is in contact with the second region 20 having the relatively high coefficient of friction. Therefore, the action of the recoil of the ball is enhanced, and it becomes possible to prevent the backspin from being largely increased.

As described above, in the head 1 in the present embodiment, since the change in the backspin due to the so-called vertical gear effect is suppressed, the flight distances of hit balls are stabilized even if the ball hitting position is varied in the vertical direction on the face 2*a*.

If the lowest point 10P on the first region 10 is too low, when a ball is hit by a lower part of the face 2*a*, there is a possibility that the ball is in contact with the first region 10 and the backspin is excessively increased to decrease the flight distance of the ball.

Figure 7:
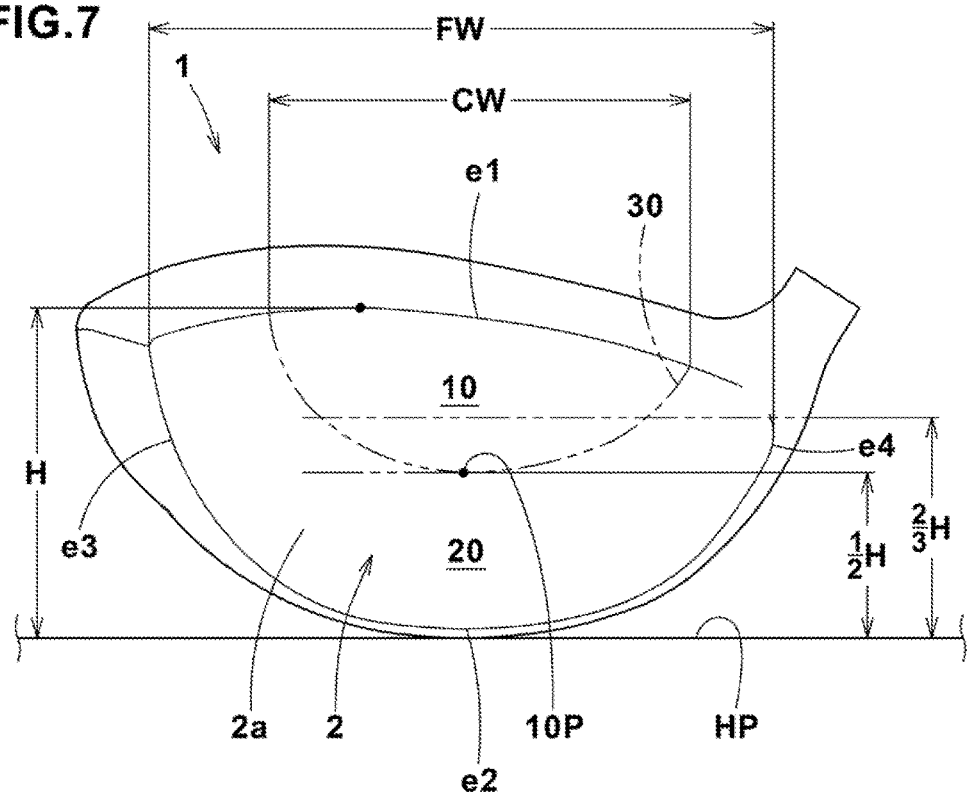

From this point of view, it is desirable that the lowest point 10P on the first region 10 is located at a position not lower than a point at ½ of the maximum height H of the face 2*a* as shown in FIG. 7. The maximum height of the face 2*a* is defined by the vertical height from the horizontal plane HP to the highest point on the upper edge e1 of the face 2*a*.

If the lowest point 10P on the first region 10 is too high, when a ball is hit by an upper side of the face 2*a*, there is a possibility that the ball is in contact with the second region 20 and the backspin is excessively reduced to decrease the flight distance of the ball.

From this point of view, it is desirable that the lowest point 10P on the first region 10 is located at a position not higher than a point at ⅔ of the maximum height H of the face 2*a*.

Further, it is desirable that the sweet spot ss of the head is located at a height between ⅔ of the maximum height H and ½ of the maximum height H.

It is preferable that the sweet spot ss is located at the same height as the lowest point 10P.

Further, it is desirable that the width CW in the toe-heel direction of the first region 10 is set in a range from 40% to 60% of the maximum width FW in the toe-heel direction of the face 2*a* as shown in FIG. 7.

Furthermore, in the present embodiment, the entire toe side part of the face 2*a* and the entire heel side part of the face 2*a* are formed as the second region 20. Accordingly, when a ball is hit on the toe or heel, the ball is in contact with the second region 20 having the relatively high coefficient of friction. Therefore, the action of the recoil of the ball is enhanced, and it is possible to adjust the side spin appropriately by the lateral gear effect. This suppresses the curving of the ball trajectory to the right or left to reduce the variation of the flying distance caused thereby.

Such action is particularly effective in the head 1 in the present embodiment having a large lateral moment of inertia and a large bulge radius.

It is preferable that the boundary 30 between the first region 10 and the second region 20 is curved convexly toward a lower side of the face in an arc in the front view of the head 1. In the present embodiment, the boundary 30 extends smoothly along the toe side edge e3, the lower edge e2 and the heel side edge e4 of the face 2*a*. However, the present invention is not limited to such embodiment, the boundary 30 may be configured variously. For example, the border 30 may be a v-shape.

As described above, the head 1 of the present embodiment can exert an advantageous effect capable of stabilizing the flying distance of the hit ball even if the ball hitting position is off centered in the vertical direction as well as the horizontal direction of the face 2*a*.

In the present embodiment, the lateral gear effect of the head 1 whose lateral moment of inertia is large, is lessened as described above. However, if the ball hitting position is largely off centered toward the toe or heel of the face 2*a*, the side spin is still liable to increase.

From this point of view, it is desirable that the surface roughness of the second region 20 varies so as to gradually increase toward the toe and toward the heel from the central position of the face 2*a* in the toe-heel direction. Accordingly, the effect of the recoil is more enhanced when the boll hitting position is greatly off centered toward the toe or heel of the face 2*a*, and thereby, the side spin is optimized for reducing the curving of the ball trajectory to the right or left.

The surface roughness of the first region 10 and the second region 20 can be evaluated in a variety of parameters. For example, various surface roughness parameters which are defined in Japanese Industrial standard (FIs) B0601 can be used. For example, the arithmetic average roughness Ra can be used as the surface roughness. In this case, the difference in the arithmetic average roughness Ra between the first region 10 and the second region 20 is preferably set to be not smaller than 0.5 micrometer. If the difference is less than 0.5 micrometers, since the surface roughness of the first region 10 approaches that of the second region 20, the effect of suppressing the variation in the ball flying distance when the ball hitting position is off centered may not be sufficiently exerted. on the other hand, if the difference is too large, there is a possibility that the head goes against the Golf Rules.

From this point of view, the difference in the arithmetic average roughness Ra between the first region 10 and the second region 20 is preferably set in a range from 0.5 to 4 micrometers, more preferably in a range from 1 to 4 micrometers.

The arithmetic mean roughness Ra of the first region 10 is preferably set in a range from about 1 to 3 micrometers.

Further, together with or instead of the arithmetic mean roughness Ra, the maximum height roughness Rz can be used as the surface roughness.

Preferably, the difference in the maximum height roughness Rz between the first region 10 and the second region 20 is set to be not less than 5 micrometers. If the difference in the maximum height roughness Rz is less than 5 micrometers, since the surface roughness of the first region 10 approaches that of the second region 20, there is a tendency that the effect of suppressing the variation in the ball flying distances when the ball hitting positions are varied, can not be fully exerted. on the other hand, if the difference is too large, there is a possibility that the head goes against the Golf Rules.

From this point of view, the difference in the maximum height roughness Rz between the first region 10 and the second region 20 is preferably set in a range from 5 to 15 micrometers, more preferably from 7 to 13 micrometers.

Preferably, the maximum height roughness Rz of the first region 10 is set in a range from about 10 to 18 micrometers.

The first region 10 and the second region 20 can be formed by, for example, shot blasting, polishing, etc. with different processing conditions therebetween.

While detailed description has been made of preferable embodiments of the present invention, the present invention can be embodied in various forms without being limited to the illustrated embodiments. In particular, the embodiments should not be construed as being independent of each other, and one embodiment whose element is replaced by an element of another embodiment should be understood as being within the scope of the present invention.

Comparison Test 1

In order to confirm the effect of the present invention, wood-type hollow titanium-alloy heads were experimentally manufactured based on the structure shown in FIGS. 1-4 and specifications listed in Table 1, and wood-type golf clubs were prepared by attaching the heads to identical shafts.

Common specifications are as follows.

club length: 45 inches head volume: 460 cc loft angle: 10 degrees lateral moment of inertia: 4000 g sq. cm bulge radius: 12 inches maximum height of face H: 54 mm width CW of first region: 64% of maximum face width FW The surface roughness (Ra, Rz) of the face was measured with an optical 3D measurement device "INFINITE FOCUS" (trade name) manufactured by ALICONA. In each region, the surface roughness (Ra, Rz) was measured at three arbitrarily-selected measuring positions, and their average value was adopted.

For each of the clubs, a ball striking test was carried out, wherein the club was attached to a swing robot, and hit balls six times per each of the following hitting positions at the head speed of 45 m/s, and the flight distance and backspin were measured to obtain the respective average values.

The hitting positions were:

face center in the vertical and toe-heel directions of the face, 5 mm above the face center, 10 mm above the face center, and 5 mm below the face center.

The test results are shown in Table 1.

From the test results, it was confirmed that the golf club heads according to the present invention can be suppressed in the variation of the ball flying distances as compared with the comparative examples.

Comparison Test 2

Further, a ball striking test was carried out by changing the surface roughness of the second region, the lateral moment of inertia of the head, and the radius of the face bulge as shown in Table 2, wherein the hitting positions were:

20 mm heel side of the face center, and 20 mm toe side of the face center, and the side spin and the lateral deviation from the target trajectory were measured.

The test results are shown in Table 2.

From the test results, it was confirmed that the heads according to the present invention were significantly improved in the directionality of the hit balls as compared with the comparative example.

TABLE 1

| Head | Ref. 1 | Ref. 2 | Ref. 3 | Ex. 1 | Ex. 2 | Ex. 3 | Ex. 4 | Ex. 5 |
|---|---|---|---|---|---|---|---|---|
| First region arithmetic mean roughness | | | | | | | | |
| Ra (micrometer) | 4.2 | 1 | 4.2 | 1 | 2.1 | 2.1 | 1 | 1 |
| maximum height roughness | | | | | | | | |
| Rz (micrometer) | 25 | 12 | 25 | 12 | 18 | 18 | 12 | 12 |
| Second region arithmetic mean roughness | | | | | | | | |
| Ra (micrometer) | 4.2 | 1 | 1 | 4.2 | 4.2 | 3 | 5.5 | 1.5 |
| maximum height roughness | | | | | | | | |
| Rz (micrometer) | 25 | 12 | 12 | 25 | 25 | 21 | 40 | 15 |
| Difference in Ra | 0 | 0 | −3.2 | 3.2 | 2.1 | 0.9 | 4.5 | 0.5 |
| Difference in Rz | 0 | 0 | −13 | 13 | 7 | 3 | 28 | 3 |
| Position of lowest point on first region | H/2 | H/2 | H/2 | H/2 | H/2 | H/2 | H/2 | H/2 |
| Backspin (rpm) | | | | | | | | |
| 10 mm above | 1250 | 1800 | 1230 | 1750 | 1530 | 1480 | 1780 | 1720 |
| 5 mm above | 1920 | 2030 | 1940 | 2110 | 2020 | 2000 | 1980 | 2010 |
| face center | 2530 | 2570 | 2560 | 2520 | 2500 | 2510 | 2520 | 2520 |
| 5 mm below | 2710 | 3000 | 2980 | 2730 | 2710 | 2780 | 2650 | 2900 |
| Flying distance (yard) *1 | | | | | | | | |
| 10 mm above | 241(−4.4) | 247.5(+1.9) | 240.4(−4.6) | 247.5(−0.8) | 246.8(+1.3) | 246.0(+0.4) | 247.3(+2.1) | 247(+1.6) |
| 5 mm above | 247.8(+2.4) | 248.2(+2.6) | 247.3(+2.3) | 247.8(+2.5) | 248(+3) | 247.8(+2.2) | 248.2(+3.0) | 248.3(+2.9) |
| face center | 245.4 | 245.6 | 245 | 245.3 | 245.5 | 245.6 | 245.2 | 245.4 |
| 5 mm below | 243(−2.4) | 238.5(−7.1) | 239(−6) | 243.2(−2.1) | 243(−2.5) | 243.0(−2.6) | 244.2(−1.0) | 241.5(−3.9) |

*1 The values in parentheses are differences from those at the face center.

TABLE 2

| Head | Ex. 6 | Ex. 7 | Ex. 8 | Ex. 9 | Ex. 10 | Ex. 11 | Ref. 4 |
|---|---|---|---|---|---|---|---|
| Second region | | | | | | | |
| Ra (micrometer) | 4.2 | 4.2 | 4.2 | 4.2 | 4.2 | 4.2 | 1 |
| Rz (micrometer) | 25 | 25 | 25 | 25 | 25 | 25 | 12 |
| Bulge radius R | 12 | 14 | 16 | 14 | 14 | 14 | 14 |
| Lateral moment of inertia (g sq · cm) | 4000 | 4000 | 6000 | 3500 | 6500 | 3300 | 4000 |
| Side spin (rpm) | | | | | | | |
| 20 mm toe side | −570 | −675 | −750 | −880 | −250 | −1030 | −475 |
| 20 mm heel side | 580 | 705 | 850 | 930 | 480 | 1010 | 655 |
| Lateral deviation (yard) | | | | | | | |
| 20 mm toe side | 6.0 right | 5.4 right | 1.8 left | 2.3 left | 8.2 right | 4.8 left | 10.3 right |
| 20 mm heel side | 2.8 left | 3.4 left | 4.3 right | 2.7 right | 5.4 left | 5.2 right | 6.6 left |
| total | 8.8 | 8.8 | 6.1 | 5.0 | 13.6 | 10.0 | 16.9 |

DESCRIPTION OF THE REFERENCE SIGNS

1 wood-type golf club head
2 face portion
2*a* face
10 first region
10P lowest point on first region
20 second region
30 boundary
e1 upper edge of face
H maximum height of face
R radius of face bulge

The invention claimed is:

1. A wood-type golf club head comprising:

a face portion having a face for striking a ball, the face comprising a first region having a surface roughness and a second region having a surface roughness larger than that of the first region, wherein the first region is positioned centrally in a toe-heel direction of the face and in an upper side of the face, and the second region is positioned adjacently to the first region on a toe side, a heel side and a lower side of the first region and the second region is formed in a U-shape in the front view of the head.

2. The wood-type golf club head according to claim 1, wherein a toe side part and a heel side part of the second region extend to an upper edge of the face.

3. The wood-type golf club head according to claim 2, wherein the boundary between the first region and the second region is curved convexly toward a lower side of the face in an arc in the front view of the head.

4. The wood-type golf club head according to claim 3, wherein the lowest point on the first region is located at a position not higher than a point at ⅔ of the maximum height of the face.

5. The wood-type golf club head according to claim 2, wherein the lowest point on the first region is located at a position not lower than a point at ½ of the maximum height of the face.

6. The wood-type golf club head according to claim 2, wherein the lowest point on the first region is located at a position not higher than a point at ⅔ of the maximum height of the face.

7. The wood-type golf club head according to claim 1, wherein the boundary between the first region and the second region is curved convexly toward a lower side of the face in an arc in the front view of the head.

8. The wood-type golf club head according to claim 7, wherein the lowest point on the first region is located at a position not lower than a point at ½ of the maximum height of the face.

9. The wood-type golf club head according to claim 7, wherein the lowest point on the first region is located at a position not higher than a point at ⅔ of the maximum height of the face.

10. The wood-type golf club head according to claim 1, wherein the lowest point on the first region is located at a position not lower than a point at ½ of the maximum height of the face.

11. The wood-type golf club head according to claim 1, wherein the lowest point on the first region is located at a position not higher than a point at ⅔ of the maximum height of the face.

12. The wood-type golf club head according to claim 1, wherein a moment of inertia of the head about a vertical axis passing through the center of gravity of the head is from 3500 to 6000 (g sq. cm), and the face is provided with a bulge having a radius of from 10 to 16 inches.

13. The wood-type golf club head according to claim 1, wherein the difference in the arithmetic average roughness Ra between the first region and the second region is not less than 0.5 micrometers, and the difference in the maximum height roughness Rz between the first region and the second region is not less than 5 micrometers.

14. The wood-type golf club head according to claim 1, wherein the difference in the arithmetic average roughness Ra between the first region and the second region is not less than 0.5 micrometers and not more than 4.0 micrometers, and the difference in the maximum height roughness Rz between the first region and the second region is not less than 5 micrometers and not more than 15 micrometers.

* * * * *